US005825722A

United States Patent [19]

Meyrat et al.

[11] Patent Number: 5,825,722

[45] Date of Patent: Oct. 20, 1998

[54] TIMEPIECE COMPRISING A CASE WHEREIN A CLOCKWORK MOVEMENT IS HOUSED

[75] Inventors: Clément Meyrat, Le Landeron; Jean-Christophe Rothen, Bienne, both of Switzerland

[73] Assignee: SMH Management Services AG, Biel, Switzerland

[21] Appl. No.: 729,532

[22] Filed: Oct. 11, 1996

[30] Foreign Application Priority Data

Oct. 27, 1995 [FR] France ..... 95 12728

[51] Int. Cl.[6] ..... G04B 37/00

[52] U.S. Cl. ..... 368/276; 368/300

[58] Field of Search ..... 368/88, 276, 280, 368/284, 287, 294, 299, 300

[56] References Cited

U.S. PATENT DOCUMENTS

| | | | |
|---|---|---|---|
| 3,691,758 | 9/1972 | Schneider | 368/300 |
| 3,863,436 | 2/1975 | Schwartzschild | 368/300 |
| 5,043,957 | 8/1991 | Kaelin | 368/300 |
| 5,333,123 | 7/1994 | Plancon et al. | 368/276 |

FOREIGN PATENT DOCUMENTS

| | | |
|---|---|---|
| 1 541 847 | 9/1968 | France . |
| 2 254 251 | 7/1975 | France . |

*Primary Examiner*—Vit W. Miska

*Attorney, Agent, or Firm*—Griffin, Butler, Whisenhunt & Kurtossy

[57] ABSTRACT

Timepiece comprising a caseband (2) capable of being elastically deformed whose internal wall (20) has a first protruding part (23, 24) and a second protruding part (28) forming a stop for the movement (50) associated with the dial (52). When the movement is inserted into the caseband, the first protruding part is passed via the rim (56) of movement by the application of pressure (58) on the movement resulting in a separating force of the case band thanks to the specific profile of the first protruding part. Once in place, the movement surmounted by dial is held in a fixed position in the caseband by means of the first and second protruding parts.

10 Claims, 7 Drawing Sheets

TIMEPIECE COMPRISING A CASE WHEREIN A CLOCKWORK MOVEMENT IS HOUSED

The present invention relates to a timepiece, in particular a wristwatch, comprising a case or housing wherein a clockwork movement is housed.

For obvious reasons, the clockwork movement has to be maintained within the case in a fixed position with respect to the case. For this purpose, several arrangements have been developed by men skilled in the art. However, these arrangements are relatively complex and expensive.

An aim of the invention is to provide a timepiece comprising a system for fixing the movement to the case which is simple and inexpensive.

The invention thus concerns a timepiece comprising a case and a movement comprising a rim on at least a portion of its periphery, the case comprising a caseband having an opening for inserting the movement and an internal wall, this internal wall defining an insertion direction for the movement and a housing for this movement. This timepiece is characterised in that the caseband is able to be deformed elastically and in that the internal wall has a first protruding part and a second protruding part between which the rim of the movement is at least partially placed, these first and second protruding parts positioning the movement in said insertion direction. The first protruding part has, in a first region superposed onto said rim and situated on the side of said opening with respect to a raised region of this first protruding part, a profile, in a cross-section plane parallel to said insertion direction, the tangent of which at any point has an angular deflection relative to the insertion direction which is less than 90 degrees.

Thanks to the above mentioned characteristics of the timepiece according to the invention, it is possible to insert the movement through said opening provided in the caseband and to put it in place via a simple pressure thereon. Indeed, the capacity of the caseband to elastically deform together with the particular profile of the first protruding part allows the movement to be inserted by exerting sufficient pressure on the movement for the rim of the movement to pass the first protruding part. The movement is then positioned by the first and second protruding parts.

According to a preferred embodiment of the invention, the first protruding part is not provided on the entire periphery of said internal wall. This allows the deformation capacity of the whole caseband to be used for locally overcoming the first protruding part when the movement is inserted into the case. Various prototypes made by the applicant have shown that, in this preferred embodiment, it is possible to preserve for the caseband a sufficiently strong and hard material which has only a low local elasticity without damaging either the movement or the caseband when the movement is inserted.

It is to be noted that according to various alternatives, the movement can be inserted either through the opening on the back cover side or through the opening on the bezel side.

Moreover, it is to be noted that it is possible to provide a profile of the first protruding part or the second protruding part allowing the extraction of the movement from the case by exerting pressure on the movement.

Other features and advantages of the invention will also appear upon reading the following description made with reference to the attached drawings in which.

Figure 1:
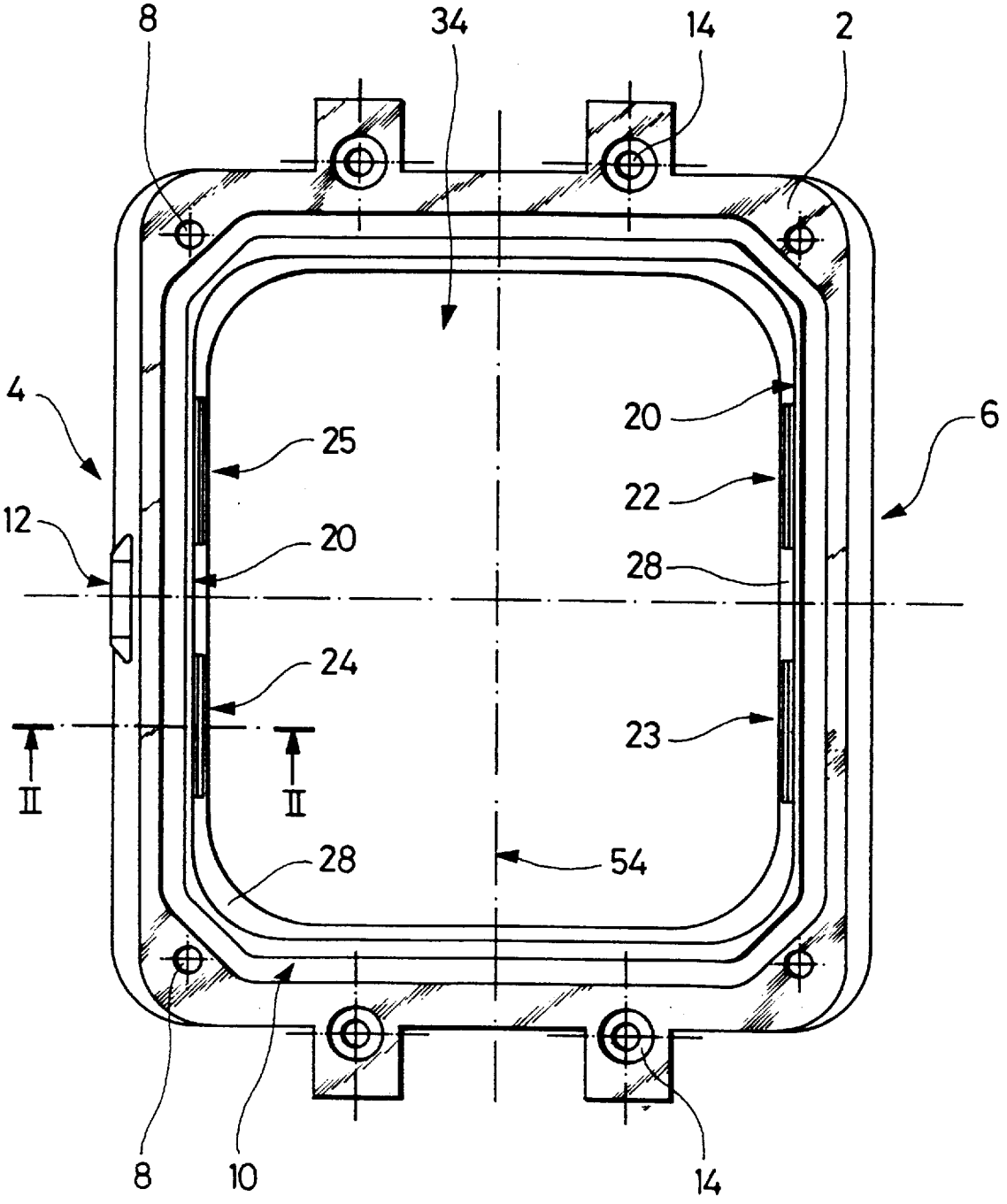
FIG. 1, is a bottom view of a caseband belonging to a first embodiment of a watch according to the invention.
Figure 2:
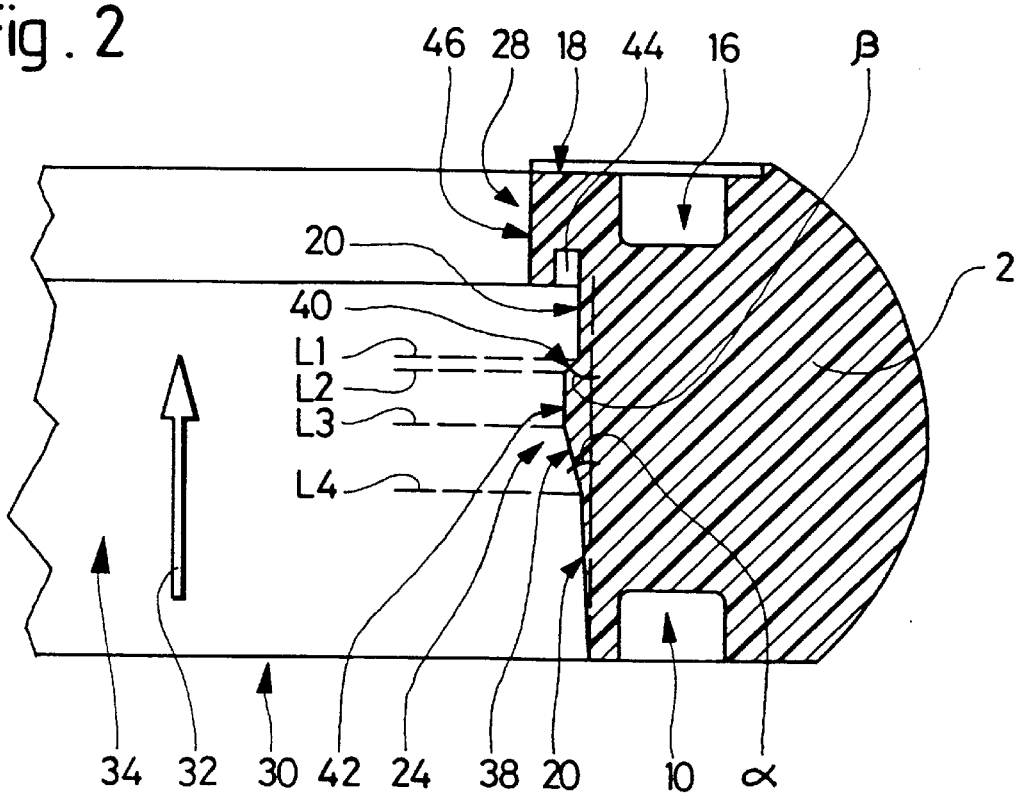
FIG. 2 is a cross-sectional view showing a transversal section of the caseband taken along line II—II of FIG. 1.

Referring to FIGS. 1 and 2, a caseband belonging to a first embodiment of a watch according to the invention will be described hereinbelow.

The caseband 2 has essentially a geometric rectangular shape comprising four rectilinear parts, in particular two longitudinal parts 4 and 6 aligned along a same longitudinal direction of caseband 2. In a conventional manner, such caseband is provided so as to be associated with a removable back cover by means of screws inserted in screw holes 8. Caseband 2 comprises a lower groove 10 intended to accommodate a sealing gasket and a hole 12 for the passage of a stem associated with the clockwork movement inserted in the caseband. Caseband 2 also comprises four holes 14 for the passage of screws associated with the means for attaching the bracelet to the caseband, said holes will be described briefly hereinafter.

As shown in FIG. 2, caseband 2 also comprises an upper groove 16 intended to accommodate a sealing gasket in contact with the watch crystal (not shown), this crystal abutting the surface 18 of caseband 2.

Moreover, caseband 2 comprises on its internal wall 20 preferably four protrusions 22, 23, 24, and 25 together forming a first protruding part of caseband 2. Internal wall 20 also has a second protruding part 28. In the present embodiment, protruding part 28 forms a flange of the watch and acts as a stop for a clockwork movement and its dial inserted in the caseband as it will be described in more detail hereinafter.

Internal wall 20 of caseband 2 defines an opening 30 for the insertion of a movement therein. Moreover, internal wall 20 defines a direction for inserting 32 said movement in said caseband, such internal wall also defining a case or housing 34 for said movement and said dial associated with the latter.

The first protruding part, in particular protrusion 24 in FIG. 2, has three distinct regions. The first region, comprised between construction lines L3 and L4, has a profile defining an oblique segment of a line 38 which is staggered at an angle $\alpha$ in relation to insertion direction 32. By way of example, the value of angle $\alpha$ is equal to 15°.

The second region of the first protruding part is situated between construction lines L1 and L2. The profile of the first protruding part in such second region defines an oblique segment of a line 40 which is staggered at an angle $\beta$ in relation to insertion direction 32.

Finally, the first protruding part comprises a third region situated between construction lines L2 and L3 defining a raised region of such first protruding region. In FIG. 2 the profile of the first protruding part in the raised region defines a segment of a line 42 parallel to insertion direction 32. However, it will be noted that the raised region may, in alternative embodiments, have a quasi zero height, which means quasi superposing construction lines L2 and L3. In such case, the profile of the first protruding part in this raised region is brought to a raised point separating the first and second regions of this first protruding part.

It will be noted that a recess 44 is provided in second protruding part 28, such recess being provided in the lower part of second protruding part 28 and set back from the surface 46 defining the visible surface of the flange through the crystal (not shown) of the timepiece. Moreover, recess 44 is situated facing first protruding part 22, 23, 24, and 25.

Figure 3A:
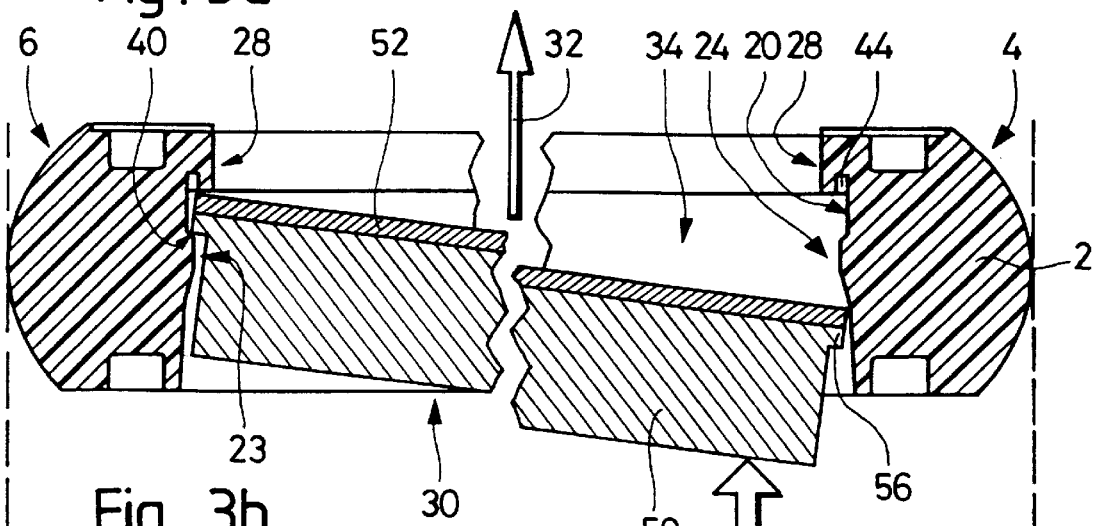
FIG. 3 (3*a*, 3*b*, 3*c*) shows schematically a first mode for inserting a clockwork movement in the caseband illustrated in FIGS. 1 and 2.
Figure 3B:
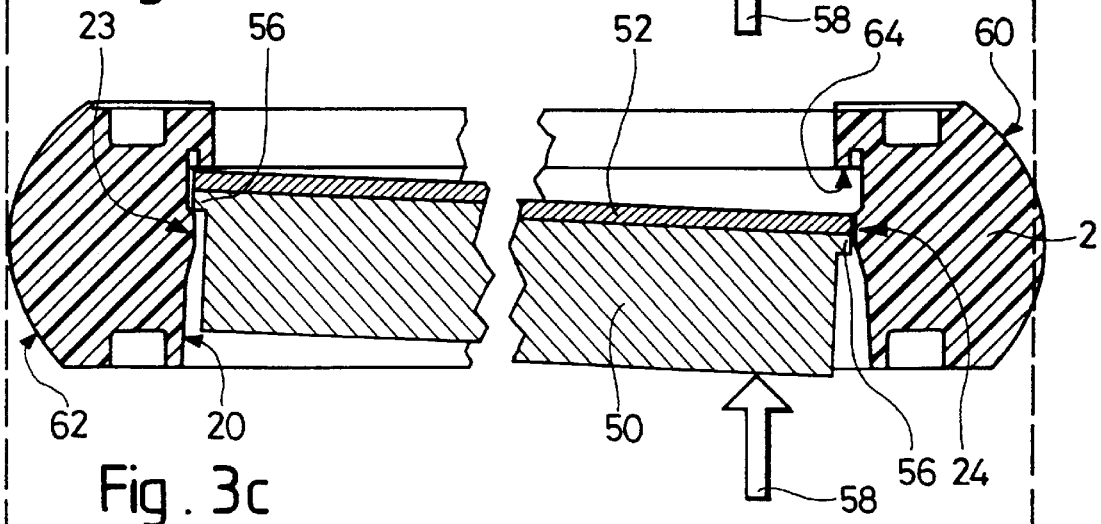
Figure 3C:
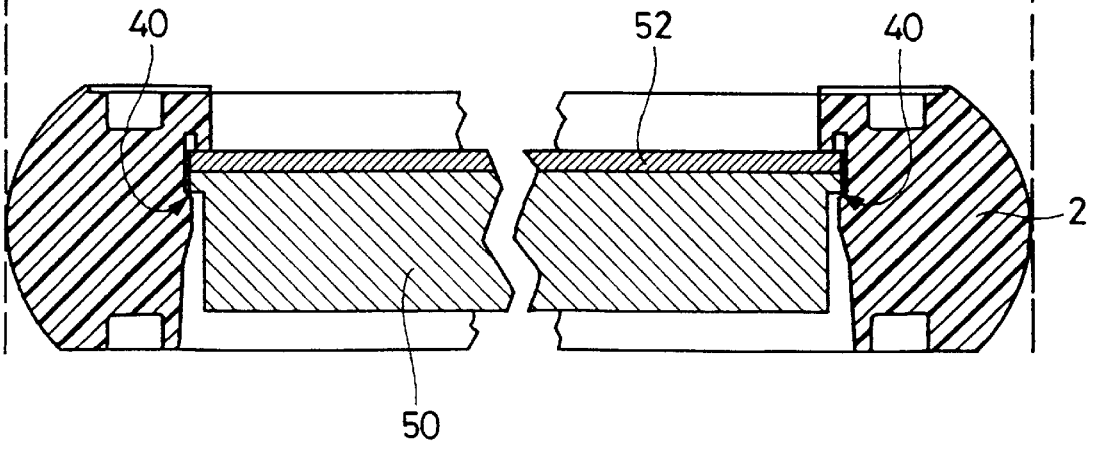

Referring to FIG. 3 (3*a*, 3*b*, 3*c*), a first insertion mode of a movement 50 associated with a dial 52 inside housing 34 of caseband 2 via opening 30 of movement 50 will be described hereinafter.

It will be noted that the schematical illustration of caseband 2, movement 50 and dial 52 is partially cut-away in its central part. It will also be noted that part 4 of caseband 2, which defines the right lateral portion of the latter, is symmetrical with respect to part 6 of caseband 2, which defines the left lateral portion of the latter, with respect to median plane 54 defined in FIG. 1. Median plane 54 corresponds to the 6 o'clock-12 o'clock plane of caseband 2. Thus, protruding part 23 has a profile symmetrical with the profile of protrusion 24 with respect to insertion direction 32 in the cross-section plane of FIG. 3.

Movement 50 comprises a rim 56, provided at least partially in the peripheral region of movement 50, superposed onto the first protruding part once movement 50 has been fixedly housed within housing 34 defined by caseband 2.

According to this first insertion mode of movement 50 into caseband 2, firstly movement 50 surmounted by dial 52 is positioned slantwise in caseband 2 so that the lower part of rim 56 abuts surface 40 of protrusions 22 and 23 forming the first protruding part of the left part of caseband 2. Then, pressure 58 is exerted onto movement 50 to insert the right part of movement 50 into case 34.

According to an essential characteristic of the invention, caseband 2 is able to be elastically deformed. Thus, rim 56 or the peripheral region of dial 52 superposed onto rim 56 exerts on protrusions 24 and 25, which form the first protruding part of the right portion of caseband 2, a stretching force which serves to increase the distance separating part 4 and part 6 of caseband 2. It will be mentioned that, according to the material selected for caseband 2, the increase in said inner distance, that is to say in the distance separating protrusions 23 and 24, may be greater than the increase in the distance between the respective external surfaces 60 and 62 of parts 4 and 6 or, to the contrary, may be approximately equal.

It will be noted that the deformation generated by the insertion of movement 50 into case 34 provided for such movement in caseband 2 results in a local spreading of caseband 2 in the region of protrusions 24 and 25. However, the entire caseband is acted upon by this deformation, so that it is possible to provide a relatively strong and rigid material for caseband 2, but which is able to elastically deform along the periphery of caseband 2 sufficiently to allow rim 56 of movement 50 to pass the above defined raised region of protrusions 24 and 25. In other words, the increase in the distance separating parts 4 and 6 of caseband 2 can be compensated for over the entire periphery of caseband 2. This shows a further advantage of the invention should the first protruding part not be provided over the entire periphery of internal wall 20.

The position of second protruding part 28 in relation to first protruding part 22, 23, 24 and 25 is provided so that, when movement 50 and dial 52 are disposed in their final configuration within caseband 2, dial 52 abuts surface 64 of second protruding part 28 forming a stop and the lower part of rim 56 abuts against the surface of the above defined second region of the first protruding part. As a result, movement 50 and dial 52 associated therewith are perfectly fixed within caseband 2, without other fixing means being provided, in particular without fixation screws or a fitting ring or other means known to men skilled in the art and generally used for maintaining the movement fixed within the case of a watch.

It will also be mentioned that second protruding part 28 which forms a stop is, of course, situated on the opposite side of insertion opening 30 of movement 50 in relation to first protruding part 22, 23, 24 and 25. It will also be mentioned that dial 52 has dimensions less than or equal to those of the plate forming the upper part of movement 50 and comprising rim 56 at its upper periphery, and that is in the region where rim 56 is superposed onto the first protruding part.

As to the purpose of recess 44, it has been established that according to the material used for caseband 2, forcing passage of dial 52 and movement 50 in order to place them within caseband 2 can result in the material of internal wall 20 being torn therefrom which then forms a deposit of material on the peripheral surface of dial 52 superposed to the first protruding part. Such deposit of material is situated facing recess 44 once movement 50 and dial 52 have been put into place in caseband 2. Accordingly, surface 64 of flange 28 rests correctly on the upper surface of dial 52 without the deposit of material torn from internal wall 20 resulting in a defect in the application of dial 52 against surface 64 of flange 28.

Figure 4A:
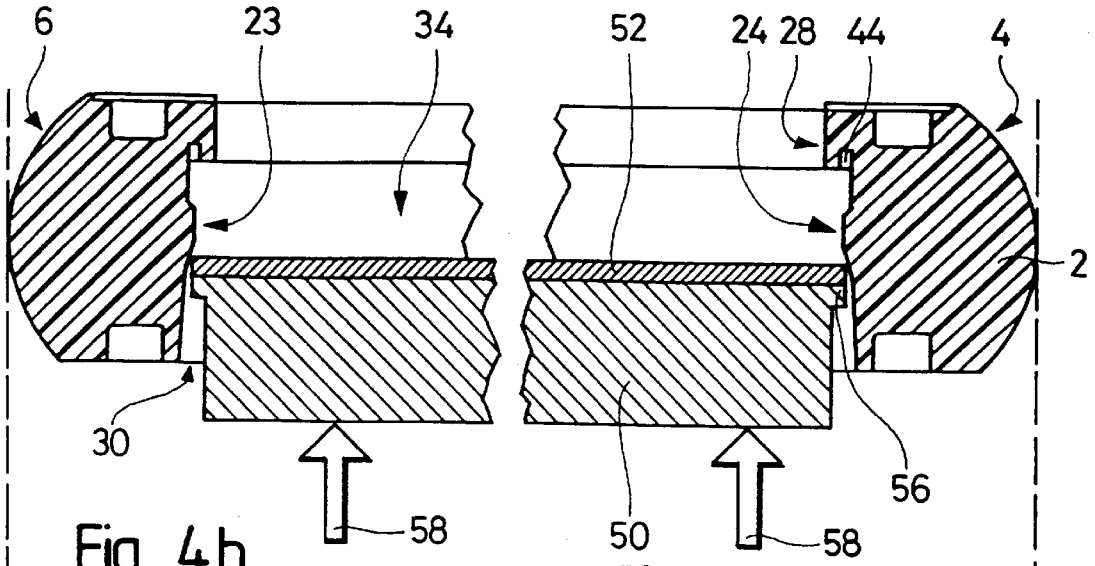
FIG. 4 (4*a*, 4*b*, 4*c*) shows schematically a second mode for inserting a clockwork movement in the caseband illustrated in FIGS. 1 and 2.
Figure 4B:
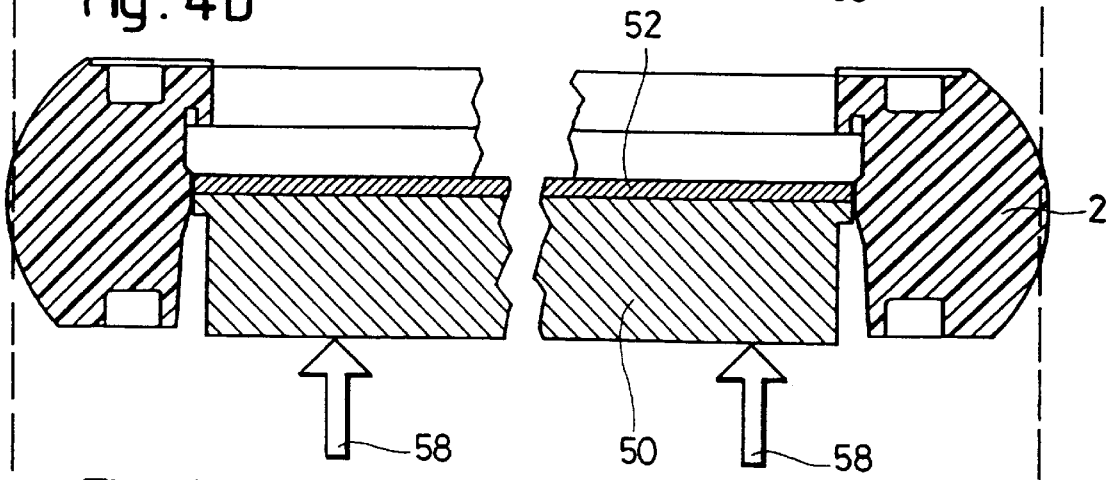
Figure 4C:
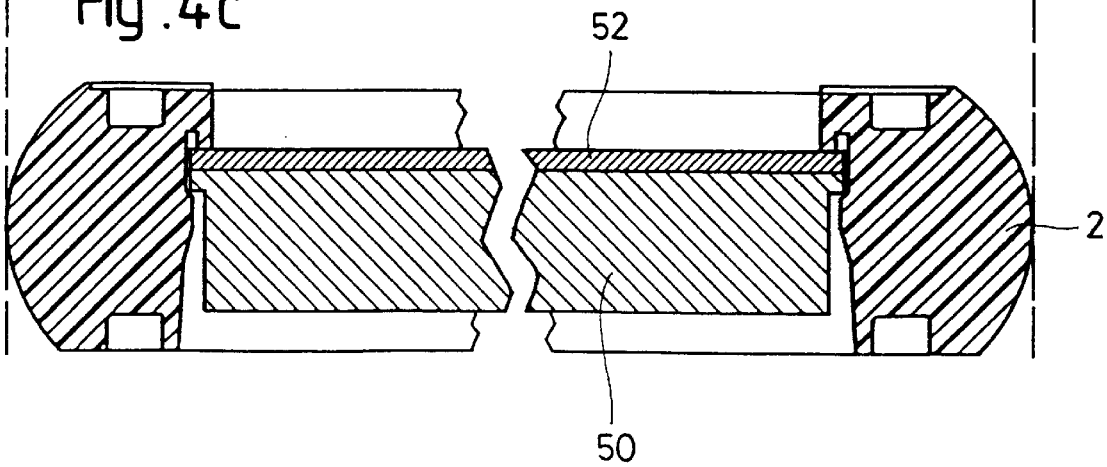

A second insertion mode of movement 50 which is associated with a dial 52, in cavity 34 provided for movement 50 and dial 52 within caseband 2 is schematically illustrated in FIG. 4 (4*a*, 4*b*, 4*c*).

The references already described above will not be described again in detail here. This second insertion mode differs from the above mentioned first insertion mode in that movement 50 and dial 52 extend substantially parallel to a general plane of caseband 2 during the whole insertion in caseband 2. To do so, a pressure is exerted in an equal manner on the left edge and right edge of movement 50. However, it will be noted that the second insertion mode necessitates a greater elastic deformation capacity of caseband 2 than that necessary for the first mode described above.

On the other hand, when the dimensions of dial 52 are less than the dimensions of movement 50 in the region superposed onto the first protruding part, this second mode allows dial 52 to be saved from pressures and mechanical stresses and thus avoids the rim being damaged.

In an alternative of the first embodiment of the timepiece according to the invention the dimensions of movement 50 and dial 52 along the 6 o'clock-12 o'clock direction are less than the corresponding dimensions of case 34 defined by caseband 2. The positioning of the movement along that direction is assured via the insertion of a stem into stem hole 12 (FIG. 1). This has the advantage of allowing the transversal portions situated between parts 4 and 6 of caseband 2 to elastically deform in a relatively free manner. In particular, this configuration allows said transversal portions to bend slightly inwards towards the centre of caseband 2 when the distance separating lateral portions 4 and 6 increases, said distance being more marked in the central part of portions 4 and 6. This is all the more true in the case of the first mode described above where protrusions 24 and 25 which should be passed via the rim of the movement are situated in the region of stem hole 12. Indeed, this hole creates less resistance to the deformation of the caseband in the region where it is situated. Thus part 4 tends to curve inwards towards the exterior of caseband 2 when the movement is inserted, which naturally results in a slight curvature of the transversal portions mentioned above towards the inside of caseband 2. However, it will be noted that the invention is not limited to this particular case and that it is also possible to fit movement 50 and/or dial 52 along the 6 o'clock-12 o'clock axis of caseband 2.

Figure 5:
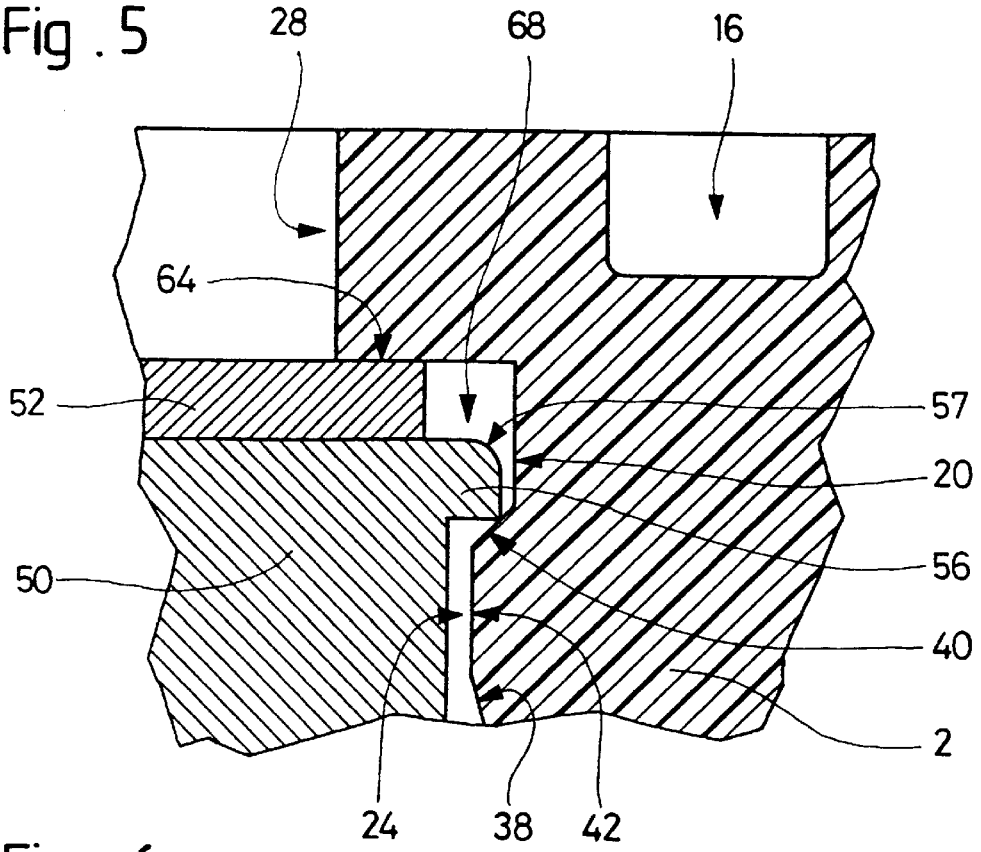
FIG. 5 shows a first alternative embodiment of caseband of FIGS. 1 and 2 in a similar cross-sectional view to FIG. 2.
Figure 6:
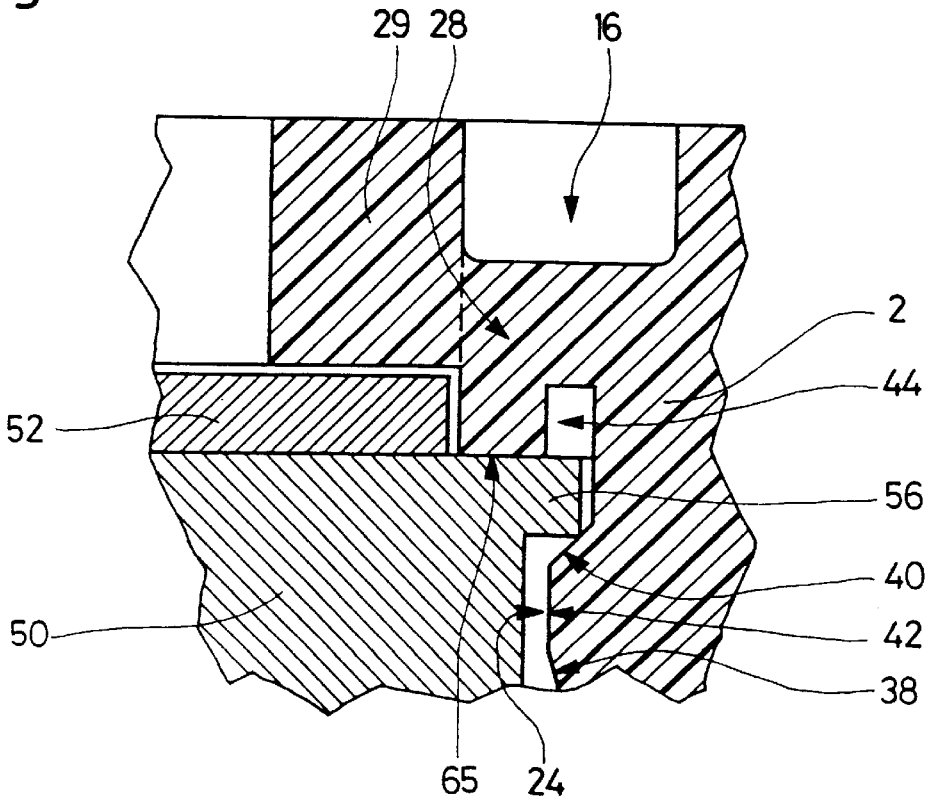
FIG. 6 shows a second alternative embodiment of the caseband of FIGS. 1 and 2 in a similar cross-sectional view to FIG. 2.

The references of FIGS. 5 and 6 described above will not be described again in detail here.

A first alternative embodiment of caseband 2 is illustrated in FIG. 5. This first alternative differs essentially in that recess 44 has been omitted since the dimensions of dial 52 are less than the dimensions of the upper part of movement 50 comprising rim 56 in the region where rim 56 is superposed onto first protruding part 24. As a result, a space 68 is defined by the lateral edge of dial 52, the upper peripheral surface of movement 50 and caseband 2. Thus, a deposit of material torn from the internal wall of caseband 2 when movement 50 is inserted will be housed in space 68 and will not disrupt an accurate positioning of the movement in the caseband, in particular with the aid of rest surfaces 64 and 40 against which dial 52 and the lower part of rim 56 respectively abut.

It will further be noted in FIG. 5 that upper part 57 of rim 56 has been rounded so as to facilitate the insertion of movement 50 and also to reduce the quantity of the material torn from internal wall 20 when the movement is inserted.

A second embodiment of caseband 2 according to the present invention is illustrated in FIG. 6. In such second embodiment, the dimensions of dial 52 are also less than those of the upper part of movement 50 comprising rim 56. Moreover, second protruding part 28 is provided so as to act as a stop via its lower surface 65 above movement 50. It is thus possible to avoid pressure being exerted on the surface of dial 52, which can be advantageous when the dial risks being damaged by pressure of the flange when movement 50 and dial 52 stops abruptly after being inserted into caseband 2. It will be noted that in this second embodiment, flange 29 can be formed by a part which is separate from caseband 2 or integral with caseband 2. It will further be noted that a recess 44 is preferably provided again for the same reasons as those described above.

Figure 8:
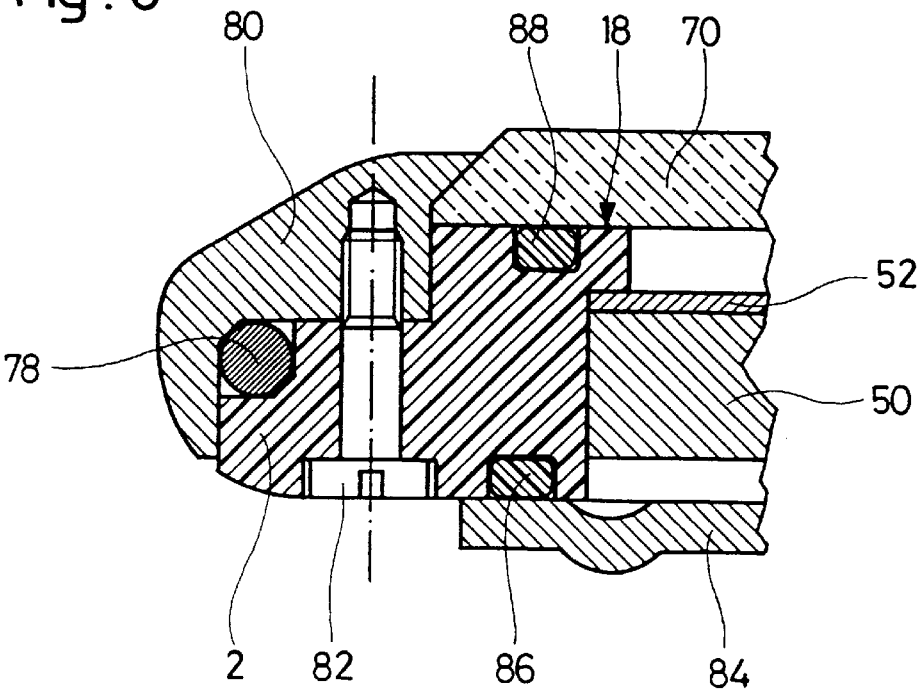
FIG. 8 is a partial cross-section of the watch illustrated in FIG. 7.

The system for fixing crystal 70 of the first embodiment of a timepiece of the invention will be described hereinafter in connection with FIGS. 7 and 8.

Figure 7:
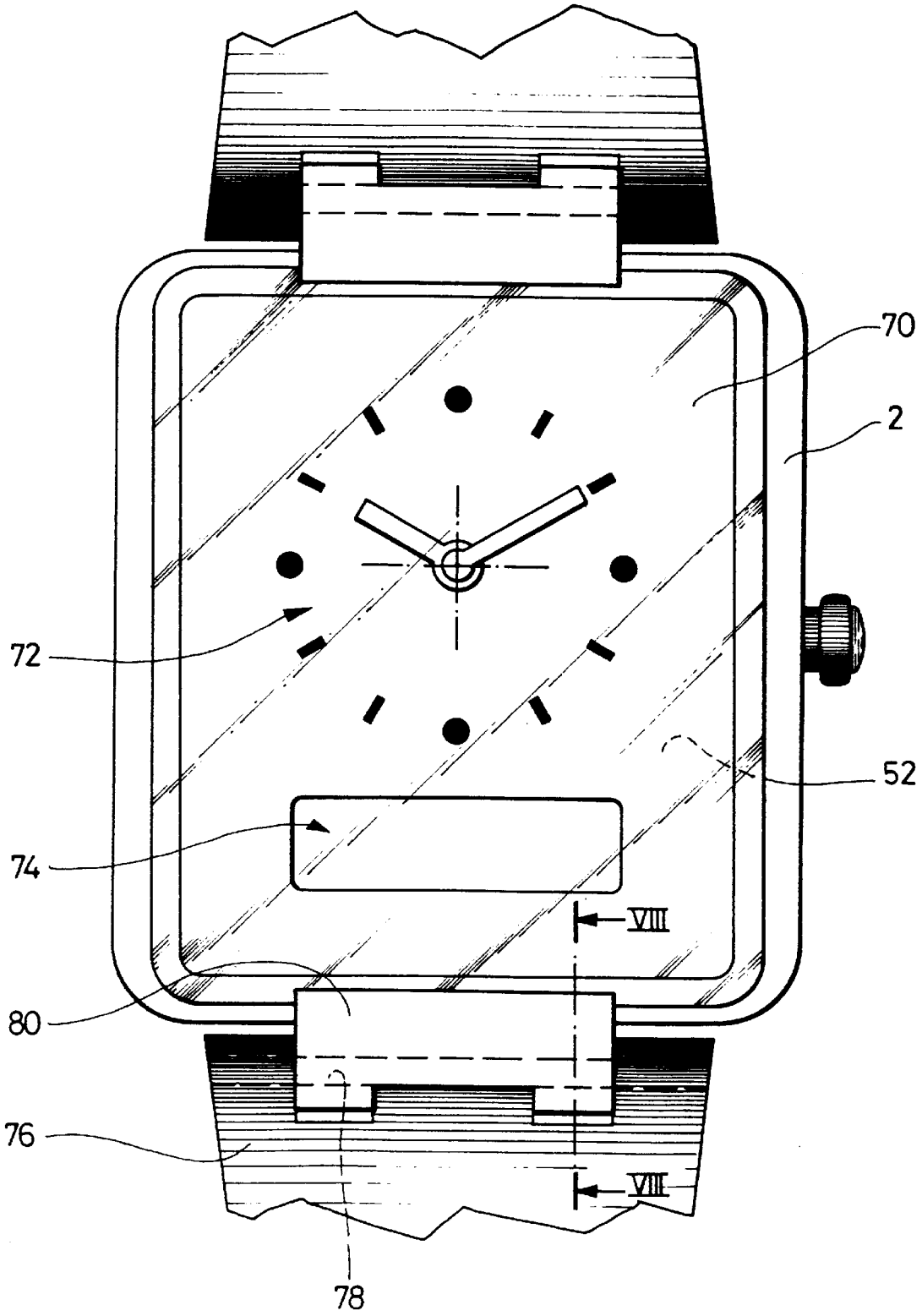
FIG. 7 is a schematical top view of the watch partially illustrated in FIGS. 1 and 2.

In FIG. 7, dial 52 comprises an analogue display 72 of the time and an additional digital display 74. A wristlet 76 is fixed to caseband 2 by means of a bar 78 and fixation means associated with bar 78, said means comprising an upper plate 80 and two fixation screws 82. As can be seen in FIG. 8, plate 80 has a dual function, i.e. holding bar 78 in place and also holding crystal 70 in place. Screws 82 allow plate 80 to be rigidly fixed to caseband 2.

Thus, it is possible to assemble crystal 70 after the insertion of movement 50 associated with dial 52. As a result, in particular in the case of a brittle crystal, the insertion of movement 50 in caseband 2 will not risk damaging crystal 70. Back cover 84 and two sealing gaskets 86 and 88 disposed in corresponding grooves 10 and 16 respectively, shown in FIG. 2, are also illustrated in FIG. 8.

However, it will be noted that according to another embodiment of the invention it is possible to insert movement 50 associated with dial 52 after the watch crystal has been put into place. However, such solution has risks in particular in the case of crystals made of glass. Thus, this other embodiment will be more suited to crystals made of a plastic material capable of undergoing certain mechanical stresses and being elastically deformed.

Figure 9:
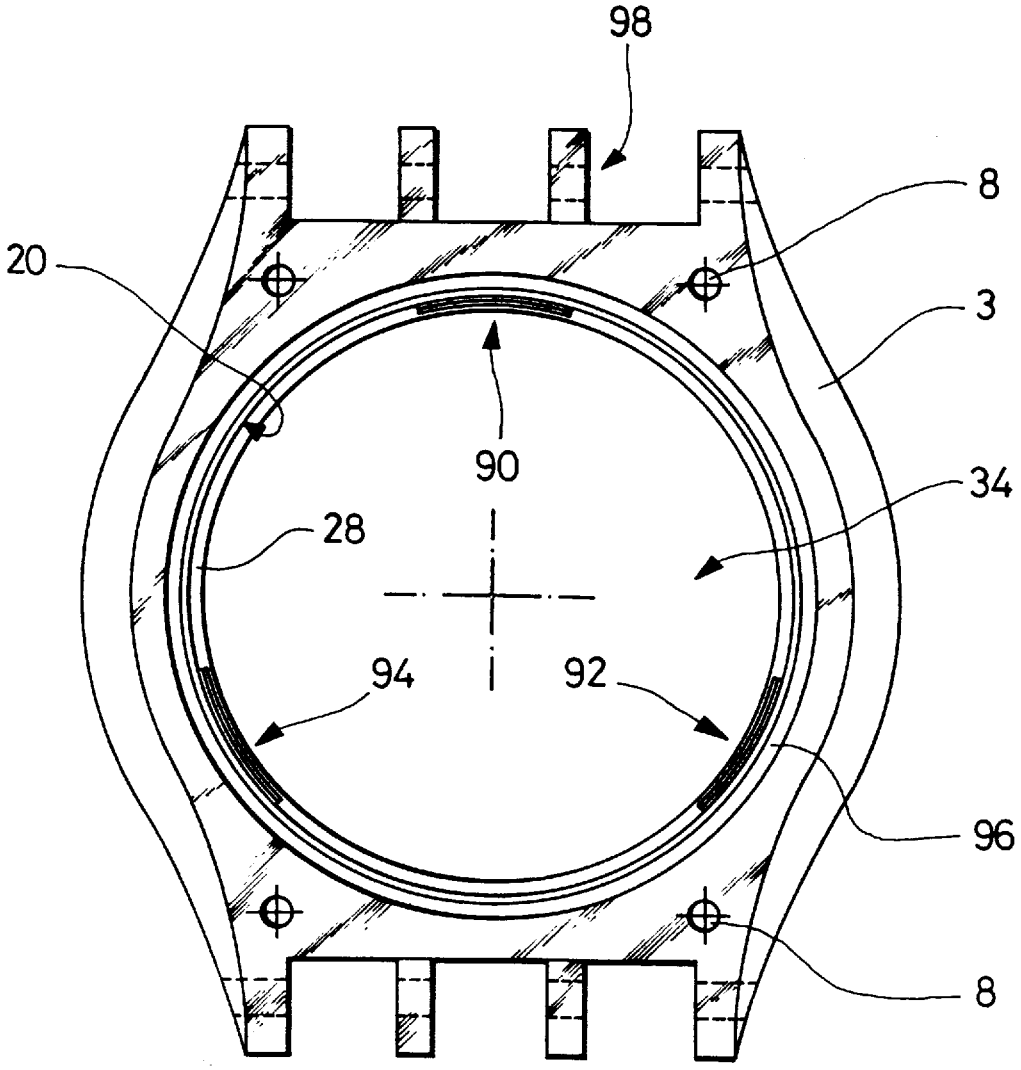
FIG. 9 is a bottom view of a caseband belonging to the second embodiment of a watch according to the invention.

A bottom view of a caseband of a second embodiment of a watch according to the invention is illustrated in FIG. 9. It will be noted that caseband 3, although not being completely circular, nonetheless defines a circular housing 34 for a movement which is also circular. Internal wall 20 has a profile similar to that of the first embodiment, with three protrusions 90, 92, and 94 staggered at an angle of 120°. These three protrusions define a first protruding part whereas second protruding part 28 is provided, as in the first embodiment, along the entire periphery of internal wall 20.

Four screw holes 8 are also provided for fixing a back cover and a circular groove 96 is intended to accommodate a sealing gasket. Caseband 3 also comprises means 98 for fixing a wristlet to caseband 3.

The crystal associated with caseband 3 integral with the bezel is a crystal made of a plastic material heat fused, glued, or driven into caseband 3.

The arrangement of three protrusions 90, 92, and 94 allows the insertion of the circular clockwork movement slantwise, in a manner similar to the insertion mode described above in connection with FIG. 3.

What is claimed is:

1. A timepiece comprising a case and a movement comprising a rim on at least a portion of its periphery, the case comprising a caseband having an opening for inserting said movement and an internal wall, this internal wall defining a direction for inserting said movement and a housing for this movement, and wherein the caseband is able to be deformed elastically and said internal wall has a first protruding part and a second protruding part between which at least partially said rim of said movement is placed, these first and second protruding parts positioning said movement in said insertion direction, said first protruding part having, in a first region superposed onto said rim and situated on the side of the opening with respect to a raised region of this first protruding part, a profile, in a cross-section plane parallel to said insertion direction, the tangent of which at any point has an angular deflection in relation to the insertion direction which is less than 90 degrees.

2. A timepiece according to claim 1, wherein said second protruding part is provided on the side opposite said opening in relation to said first protruding part, and said second protruding part forms a stop limiting the possible travel of the movement in said insertion direction in said case.

3. A timepiece according to claim 2, wherein said second protruding part forms a flange, and a dial is provided on said movement, said dial having dimensions less than or equal to those of said movement in the region where said rim is superposed onto said first protruding part, said dial abutting against a lower surface of said flange whereas said rim abuts against a surface of a second region of said first protruding part situated on the second protruding part side in relation to said raised region of said first protruding part.

4. A timepiece according to claim 2, wherein a recess is provided in said second protruding part, said recess being situated opposite said first protruding part and superposed onto the external edge of said rim of said movement.

5. A timepiece according to claim 3, comprising a back cover arranged so as to be detachable, wherein said insertion opening is situated on the side of the back cover.

6. A timepiece according to claim 1, wherein said caseband comprises two rectilinear parts situated facing each other, said internal wall being defined by straight surfaces along those two rectilinear parts, said first protruding part being provided only along said two rectilinear parts.

7. A timepiece according to claim 6, wherein said first protruding part is comprised of four distinct protrusions regularly distributed on the internal walls respectively of said two rectilinear parts of the caseband, the dimensions of said movement along an axis parallel to said straight surfaces being less than the corresponding dimensions of said case.

8. A timepiece according to claim 1, wherein said internal wall of the caseband is circular, said rim of said movement being also circular.

9. A timepiece according to claim 8, wherein said first protruding part is comprised of three distinct protrusions staggered at an angle of 120 degrees.

10. A timepiece according to claim 1, wherein said caseband is integral with a bezel.

* * * * *